US006216348B1

(12) United States Patent
Martirossian

(10) Patent No.: US 6,216,348 B1
(45) Date of Patent: Apr. 17, 2001

(54) TOOL HANDLE

(76) Inventor: Vagan Martirossian, 50-40 - 43rd St., Woodside, NY (US) 11377

( * ) Notice: Subject to any disclaimer, the term of this patent is extended or adjusted under 35 U.S.C. 154(b) by 0 days.

(21) Appl. No.: 09/172,943

(22) Filed: Oct. 14, 1998

(51) Int. Cl.[7] ..... B26B 1/00
(52) U.S. Cl. ..... 30/329; 30/332; 81/438
(58) Field of Search ..... 30/329, 332, 334, 30/335, 336; 81/9.23, 438, 439; 279/49, 53, 42; 407/29.15

(56) References Cited

U.S. PATENT DOCUMENTS

| | | | | |
|---|---|---|---|---|
| 784,289 | * | 3/1905 | Weston | 279/39 |
| 1,409,311 | * | 3/1922 | Olson | 279/48 |
| 2,619,724 | * | 12/1952 | Manthey et al. | 30/336 |
| 3,338,278 | * | 8/1967 | Reuterfors | 30/332 |
| 3,349,487 | * | 10/1967 | Robins | 30/335 |
| 5,657,541 | * | 8/1997 | Hickok et al. | 30/123 |

FOREIGN PATENT DOCUMENTS

| | | | | |
|---|---|---|---|---|
| 1522454 | * | 8/1978 | (GB) | 30/335 |

* cited by examiner

*Primary Examiner*—M. Rachuba
(74) *Attorney, Agent, or Firm*—Jordan and Hamburg LLP

(57) ABSTRACT

A tool handle permits selective adjustment of a permitted depth of insertion of a blade therein. The tool handle includes a central bore for reception of a blade through a front opening thereof, and an adjustable stop receivable in the bore, the position of which can be selectively fixed along a longitudinal central axis of the tool handle. So positioned, the stop blocks insertion of the blade beyond a fixed point along the bore selected by the user. As the blade is worn and reground, the stop is moved to a position closer to the front opening of the bore, shortening the degree of blade insertion permitted, and thus allowing a constant distance of blade extension to be maintained. Once adjusted, the blade is securable to the handle, to prevent undesirable movement during use of the assembled tool.

11 Claims, 2 Drawing Sheets

TOOL HANDLE

BACKGROUND OF THE INVENTION

The present invention relates to a tool handle, and, more particularly, to a tool handle for receiving a blade member in a manner permitting continuous maintenance of overall tool length irrespective of blade wear.

Engraving tools are well known in the art, and consist generally of a spike-shaped blade member which extends from a handle suitably configured for reception in the palm of the hand. Tools of this type are used for a variety of purposes in addition to engraving. For example, engraving tools are use by stone setters to mount diamonds and other stones in a setting. The process is carried out by fitting the stone in a receiving hole formed in the metal support to which the stone is to be mountably secured, and compressing the metal at points along a periphery of the receiving hole to form a series of beads protruding inwardly above, and in contact peripherally with, the stone, thus captively holding the stone in the setting. To maintain precise control while performing this operation, the tool is held in the hand with the handle supported at its base on the heel of the palm, and with the blade supported proximate a terminal end thereof by a suitable extended finger of the same hand in supportive contact therewith.

Repeated use of the engraving tool in performance of such tasks results in blade wear, requiring regrinding and a resultant shortening of the blade. This blade shortening adversely affects proper handling of the tool, since the distance that the blade extends forward of the handle is preferably of a constant length selected for ideal comfort and control, predetermined based upon the characteristics of the individual user's hand.

To address this need, a variety of handles are currently available, each permitting the base of a blade to be inserted to different preset depth. Selection of a suitable handle thereby allows incremental control over the overall length of the tool when a blade is inserted therein. In this manner, as a blade is worn, and its length is diminished, a handle permitting a shallower degree of blade insertion is selected to compensate for the decrease in blade length. Although somewhat effective, such solution requires purchase and storage of a plurality of handles, and does not permit continuous blade reception depth adjustment.

A tool handle permitting simple and reliable adjustment of an overall tool length when a blade is received therein, and which advantageously permits continuous adjustment of a permitted degree of blade insertion into the handle, would therefore be highly desirable.

Accordingly, it is an object of the invention to provide a tool handle which overcomes the drawbacks of the prior art.

It is a further object of the invention to provide a tool handle which permits a user thereof to selectively control a permitted depth of insertion of a blade received therein such that the degree of extension of the blade can be adjusted as needed, for example, to maintain constant tool length irrespective of blade wear.

SUMMARY OF THE INVENTION

In accordance with these and other objects of the invention, there is provided a tool handle for fixed support of a blade member which permits adjustment of a blade reception depth. Such feature allows the degree of blade extension to be user-determined based upon individual need, and permits such selected amount that the blade member extends from the tool handle to be maintained at a constant length irrespective of overall shortening of the blade member due to wear.

Briefly stated, the tool handle includes a central bore suited to reception of a blade through a front opening thereof, and an adjustable stop receivable in the bore, the position of which can be selectively fixed along a longitudinal central axis of the tool handle. So positioned, the stop blocks insertion of the blade beyond a fixed point along the bore selected by the user. As the blade is worn and reground, the stop is moved to a position closer to the front opening of the bore, shortening the degree of blade insertion permitted, and thus allowing a constant distance of blade extension to be maintained. Advantageously, although not necessarily, the stop is continuously, rather than incrementally, adjustable. Means for securing the blade to the handle are also provided.

In accordance with an embodiment of the invention, there is provided a tool handle in which a central bore extends the entire length thereof, the bore having an opening in both a front and a back face of the tool handle. The central bore is internally threaded for threadably receiving therein a threaded stop member. Means are provided, at a side of the stop facing rearward of the tool handle, for turning the stop to thereby permit adjustment of a longitudinal position thereof along the bore, conveniently in the form of a slot or other configuration adapted to use with an appropriately sized screw-driver insertable into the bore from the back of the tool handle. The side of the stop facing forward of the tool handle advantageously includes centering means for maintaining a fixed position of the inserted end of the blade, conveniently provided as a centrally-formed cylindrical countersunk bore. Securement means are carried on the handle at a location proximal to blade insertion for securing the blade thereto, conveniently provided in the form of a chuck which compressively engages the blade when tightened.

In an alternative embodiment in accordance with the invention, a tool handle permits user adjustment of blade insertion depth without the need for secondary adjustment tools. Like the above embodiment, a threaded stop is threadably received in a threaded bore in the handle, however the means provided on threaded stop for selectively moving same in a direction along a longitudinal tool axis are provided in the form of longitudinal slots which slidably receive arms of an advancement member rotatably mounted to the handle. Terminal ends of the arms are retained for rotation of the advancement member about a fixed axis. A locking nut is provided which threadably engages a threaded portion of the advancement member, and which, when tightened against the forward end of the handle, prevents rotation of the advancement member relative handle 31. When the threaded stop is to be relocated along the longitudinal tool axis, use of a secondary adjustment tool is thereby obviated. To effect adjustment, the user simply loosens the locking nut, which then permits rotation of the advancement member, and which in turn rotates the threaded stop. When a desired longitudinal stop position is reached, the locking nut is tightened against the handle, prohibiting continued undesirable rotation during use of the engraving tool.

The above, and other objects, features and advantages of the present invention will become apparent from the following description read in conjunction with the accompanying drawings, in which like reference numerals designate the same elements.

DETAILED DESCRIPTION OF THE INVENTION

Figure 1A:
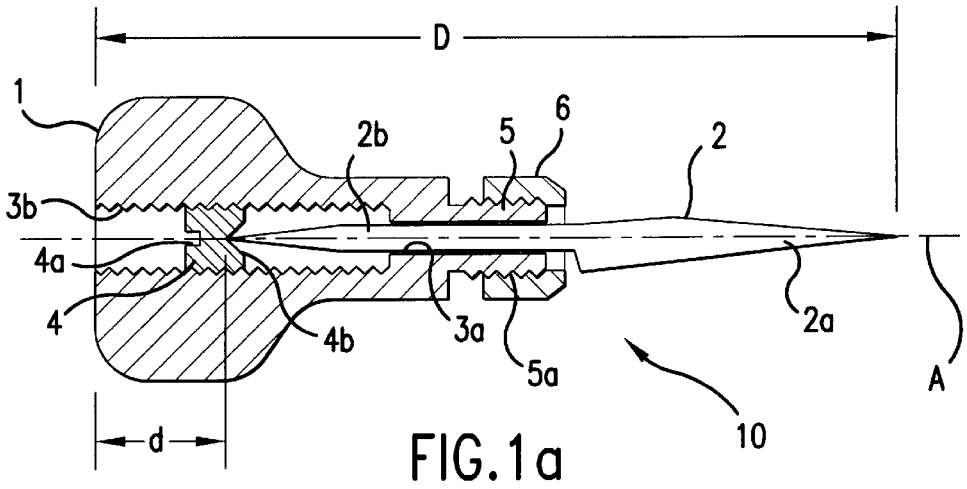
FIG. 1*a* is a cross-sectional side view of an engraving tool employing a tool handle in accordance with an embodiment of the invention, illustrating blade insertion prior to experiencing wear.

Referring to the figures, and in particular FIG. 1*a*, an engraving tool employing a tool handle in accordance with an embodiment of the invention is depicted, the engraving tool generally designated 10. Engraving tool 10 includes a handle 1 of suitable shape for comfortable reception in the hand of a user. A blade 2, which as shown, typically includes a forward portion 2*a* suitably configured for performing a stone setting operation, and a shaft portion 2*b* for securement of same to handle 1. Handle 1 includes a tool reception bore 3*a* disposed along a longitudinal tool axis A, having an opening in a forward end of handle 1 to permit reception of shaft portion 2*b* of blade 2 therein. In addition to reception bore 3*a*, handle 1 is provided with a threaded bore 3*b* also aligned with longitudinal tool axis A and communicative with reception bore 3*a*. Threaded bore 3*b* has an opening in a rearward end of handle 1 to permit threaded reception of a threaded stop 4. Means are provided for selectively locating threaded stop 4 along longitudinal tool axis, conveniently in the form of a slot 4*a* formed in a side thereof facing rearward of handle 1, to permit turning thereof in a desired clockwise or counterclockwise direction to effect travel along the longitudinal path by a screwdriver blade (not shown) inserted through the opening of threaded bore 3*b*. When blade 2 is inserted into reception bore 3*a*, as shown in FIG. 1*a*, a terminal end thereof bottoms against threaded stop 4. The position of threaded stop 4 along longitudinal tool axis A therefore determines the depth of permitted insertion of blade 2 in handle 1.

Once inserted, blade 1 is secured in the handle conveniently by structure carried at a forward end of handle 1 defining a chuck portion 5. The configuration of chuck portion 5 may be of any suitable conventional design employed for like purpose, such as any of the many keyless chuck designs commonly used for retaining a drill bit in a drill. In the depicted example, chuck portion 5 includes external threads 5*a* for threadably engaging a threaded compression member 6. One or both of external threads 5*a* or the threads comprising threaded compression member 6 are tapered threads such that inward pressure is exerted on chuck portion as threaded compression member 6 is advanced along external threads 5*a*. A series of slots (not shown) are cut longitudinally through chuck portion 5 to permit inward compressive deformation thereof in response to tightening of threaded compression member 6. When threaded compression member 6 is sufficiently tightened, the inward walls of reception bore 3*a* in the region of chuck portion 5 firmly engage shaft portion 2*b* of blade 2, holding it securely in place.

Since shaft portion 2*b* extends freely into threaded bore 3*b* of handle 1 and is unsupported therein, means are advantageously provided for securing the terminal end of shaft portion 2*b* contacting threaded stop 4 to prevent possible undesirable wobbling thereof when working pressure is applied to a terminal end of forward portion 2*a* of blade 2. Such securement means are advantageously provided in the form of a central cutout 4*b* which, in the depicted embodiment, is advantageously of conical shape to provide self-centering of the terminal end of shaft portion 2*b* regardless of its precise thickness.

Figure 1B:
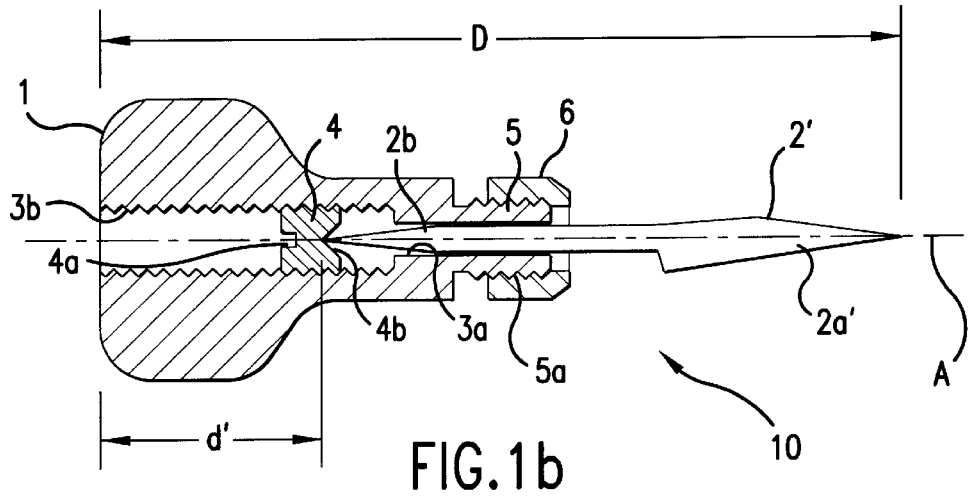
FIG. 1*b* is a cross-sectional side view of the engraving tool of FIG. 1, illustrating blade insertion after shortening of the blade due to wear adjusted to maintain constant overall tool length.

Operation of engraving tool 10 will now be described with reference to FIGS. 1*a* and 1*b*. FIG. 1*a* depicts blade 2 having minimal wear installed in handle 1. Stop 4 is adjusted to provide desirable extension of blade 2 from handle 1 suited to the user's preference. In the depicted example, once adjusted, an overall tool length is indicated by the distance D. A blade contact side of threaded stop 4 is a distance d from the rearward end of handle 1. After continued use and subsequent regrinding, the length of forward portion 2*a* of blade 2 is shortened, as shown in FIG. 1*b*. Longitudinal adjustment of threaded stop 4 permits the user to maintain a constant value for the overall tool length, i.e. distance D. To accomplish same, threaded compression member 6 is loosened about chuck portion 5, restoring slidable freedom of movement to blade 2, and threaded stop 4 is advanced along longitudinal tool axis A by clockwise rotation (assuming right-handed threads) thereof by a screwdriver blade inserted into threaded bore 3*b*. As shown in FIG. 1*b*, to maintain constant overall tool length as distance D, threaded stop 4 is moved to a longitudinal position in which a blade contact side of threaded stop 4 is a new distance d' from the rearward end of handle 1. Once the new setting is attained, threaded compression member 6 is tightened sufficiently about chuck portion 5 to effect blade-securing compression.

It is noted that chuck portion 5 in the above embodiment is integral with handle 1, thus requiring that handle 1 be fabricated from a suitably resilient material, for example, metal or plastic, to permit proper operation of the blade securement means. Alternatively, a chuck mechanism analogous in design and function with that of the above described embodiment can be fixed to the handle, permitting its fabrication using a material differing from that of the handle, and without departure from the intended scope of the invention. For example, the handle could be fashioned from wood, and a metal chuck could be fixably received thereon, such as, for example, in press fit engagement.

Figure 2:
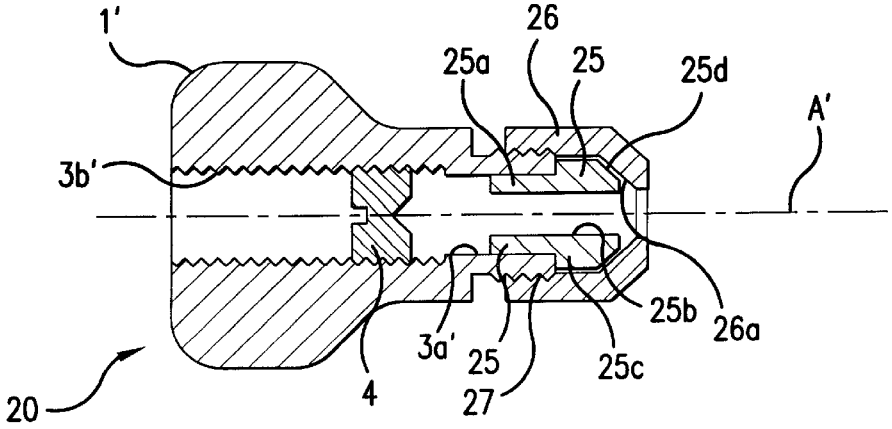
FIG. 2 is a cross-sectional side view of a tool handle in accordance with another embodiment of the invention, employing an alternative chuck which permits accommodation of a wide range of blades having various diameters.
Figure 3:
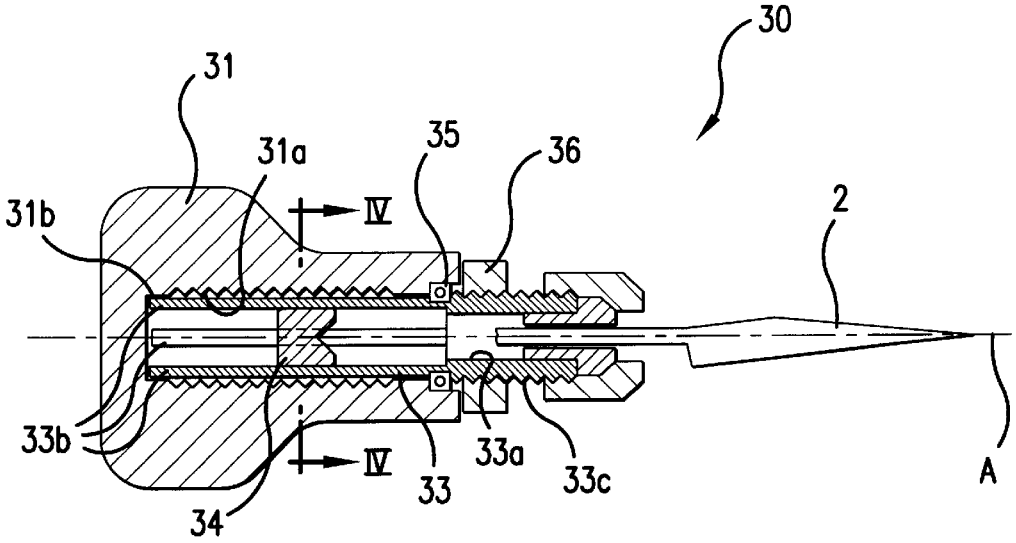
FIG. 3 is a cross-sectional side view of an engraving tool employing a tool handle in accordance with yet another embodiment of the invention, in which adjustment of blade reception depth is adjustable by rotation of an integral advancement member relative the handle.
Figure 4:
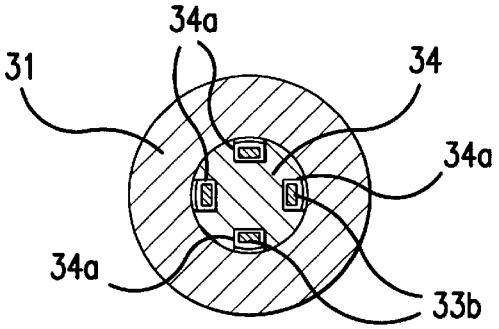
FIG. 4 is a cross-sectional view taken on line IV—IV of FIG. 3.

Turning now to FIG. 2, an alternative embodiment of an engraving tool (blade not shown) employing a handle design in accordance with the invention is shown generally at 20. Engraving tool 20 is of analogous construction with the preceding embodiment of FIGS. 1*a* and 1*b*, and differs only with respect to the chuck mechanism comprising the blade securement means. As such, threaded stop 4 is threadably received in a threaded bore 3*b*' formed in a handle 1' for movement along a longitudinal axis A' of engraving tool 20. Handle 1' also includes a reception bore 3*a*' adapted to receive a removable chuck 25 in closely conformed fit about a shaft portion 25*a* thereof. Chuck 25 further includes a central bore 25*b* through which a blade is receivable, advantageously in a minimal clearance fit, and a slotted head portion 25*c* which shoulders against a forward end of handle 1 at the opening of reception bore 3*a*'. Slotted head portion 25 includes longitudinal slots (not shown) which permit inward movement of slotted head portion 25 when compressive force is applied thereto. A threaded compression member 26 is threadably engagable with a threaded front portion 27 carried on handle 1'. Threaded compression member 26 includes an angled shoulder 26*a* which compressively engages a corresponding angled front portion 25*d* of chuck 25 when threaded compression member 26 is tightened thereagainst. Continued tightening causes chuck 25 to be inwardly deformed, compressing same against a blade (not shown) inserted therein. By making chuck 25 a separate member receivable on handle 1', a variety of chuck sizes, i.e. chucks having different diameter central bores, can be made available to fit a wide variety of blade diameters. Referring now to FIGS. 3 and 4, an engraving tool employing a handle design in accordance with an advantageous embodiment of the invention is depicted, the engraving tool generally designated 30. Engraving tool 30 includes a handle 31 in which blade 2 is fixably receivable by means of a chuck arrangement functioning analogously with either of the above described embodiments (for purposes of illustration, the example in FIG. 3 is shown as employing the chuck design of the embodiment of FIG. 2). Handle 31 includes a threaded bore 31*a* requiring an opening only in a forward side of handle 31. A threaded stop 34 is threadably received in threaded bore 31*a*. Means are provided on threaded stop 34 for selectively moving same in a direction along a longitudinal tool axis A", provided in the form of longitudinal slots 34*a* (advantageously two or more), seen best in FIG. 4. An advancement member 33 is rotatably mounted to handle 31, conveniently through a bearing 35 located at a forward end of handle 31, and includes a reception bore 33*a* through which blade 2 is receivable. Advancement member 33 includes a series of arms 33*b* which, when same is received in mounted position, extend the length of threaded bore 31*a*, and which correspond with and are configured to pass freely through longitudinal slots 34*a* in threaded stop 34. Terminal ends of arms 33*b* are retained for rotation of advancement member 33 about a fixed axis conveniently by a straight end bore 31*b* formed in handle 31, and which is of matching diameter to that of advancement member 33. A locking nut 36 is provided which threadably engages a threaded portion 33*c* of advancement member 33, and which, when tightened against the forward end of handle 31, prevents rotation of advancement member 33 relative handle 31.

By virtue of such design, when threaded stop is to be relocated along longitudinal tool axis A", the requirement of a secondary adjustment tool is obviated. Rather, the user simply loosens locking nut 36 which then permits rotation of advancement member 33 by gripping same at a forward end thereof. Rotation of advancement member 33 in turn rotates threaded stop 34 since arms 33*b* are slidably received through longitudinal slots 34 formed in threaded stop 34, and moves same in a direction along longitudinal tool axis A" dependent upon a rotational direction. When a desired position is reached, locking nut 36 is tightened against handle 31 to prohibit undesirable rotation during use of engraving tool 30.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A tool handle for securably receiving a blade member, comprising:

a handle structure defining a central bore in which at least a portion of an overall length of the blade member is slidably receivable therein and fixable therewith such that said handle structure and an extended dimension of the blade are co-directional with a longitudinal tool axis;

a stop receivable in said central bore and movable to user selectable locations along said longitudinal tool axis; and means for fixing said stop at a desired one of said selectable locations, an end of the blade member being contactable with a forward side of said stop when said at least a portion of the blade member is received in said central bore;

said stop including external threads, said central bore including a threaded portion for threadable engagement of said external threads therewith, said means for fixing said stop including said threadable engagement, movement of said stop to said user selectable locations along said longitudinal tool axis being accomplished by a turning of said stop.

2. A tool handle according to claim 1, further comprising:

an advancement member rotatably mounted to said handle structure a portion of which extends through said threaded portion of said central bore, said advancement member including a reception bore through which said at least a portion of the blade member is receivable, said stop including a plurality of longitudinal slots cut through said external threads thereof, said advancement member including a plurality of arms configured to pass freely through said longitudinal slots in said stop, terminal ends of said arms being are retained by structure internal of said handle structure which permits rotation of said advancement member about a fixed axis; and said advancement member being securable to said handle structure to selectively prevent rotation thereof with respect to one another.

3. A tool handle according to claim 2, wherein said advancement member is securable to said handle structure to selectively prevent rotation by an advancement securement mechanism including a threaded portion provided on said advancement member, and a locking nut which threadably engages said threaded portion of said advancement member, and which, when tightened against the forward end of said handle structure, prevents rotation of said advancement member relative said handle structure.

4. A tool handle for securably receiving a blade member, comprising:

a handle structure defining a central bore in which at least a portion of an overall length of the blade member is slidably receivable therein and fixable therewith such that said handle structure and an extended dimension of the blade are co-directional with a longitudinal tool axis;

a stop receivable in said central bore and movable to user selectable locations along said longitudinal tool axis;

said stop being fixable at a desired one of said selectable locations, an end of the blade member being contactable with a forward side of said stop when said at least a portion of the blade member is received in said central bore;

a blade securement mechanism carried on said handle structure forward of said stop, operation of which selectively inhibits removal of the blade member from said handle structure when said at least a portion thereof is slidably received in said central bore, such that when said end of said blade member is brought into contact with said forward side of said stop and said blade member is secured by said blade securement mechanism, said blade securement mechanism inhibits slidable movement of the blade member in a removal direction and said stop prevents movement of the blade member in a direction opposite thereto when working pressure is applied to said blade member during use; and said blade securement mechanism comprising:

a forward end of said handle structure defining a chuck portion;

an internally threaded compression member; and said chuck portion including external threads for threadably engaging said threaded compression member, a portion of said central bore in a region of said chuck portion defining a reception bore having internal walls engageable with said at least a portion of the blade member, threads of at least one of said compression member and said chuck portion being tapered threads, such that inward pressure is exerted on said chuck portion as said compression member is tightened on said chuck portion, said chuck portion permitting inward compressive deformation thereof in response to said inward pressure whereby inward walls of said reception bore firmly engage said at least a portion of the blade member, holding same securely in place.

5. A tool handle for securably receiving a blade member, comprising:

a handle structure defining a central bore in which at least a portion of an overall length of the blade member is slidably receivable therein and fixable therewith such that said handle structure and an extended dimension of the blade are co-directional with a longitudinal tool axis;

a stop receivable in said central bore and movable to user selectable locations along said longitudinal tool axis;

means for fixing said stop at a desired one of said selectable locations, an end of the blade member being contactable with a forward side of said stop when said at least a portion of the blade member is received in said central bore;

said stop including external threads, said central bore including a threaded portion for threadable engagement of said external threads therewith, said means for fixing said stop including said threadable engagement, movement of said stop to said user selectable locations along said longitudinal tool axis being accomplished by a turning of said stop;

said threaded portion having an opening in a rearward end of said handle structure; and said stop including means for cooperatingly engaging an adjustment tool inserted through said opening to permit said turning of said stop by the adjustment tool.

6. A tool handle for securably receiving a blade member, comprising:

a handle structure defining a central bore in which at least a portion of an overall length of the blade member is slidably receivable therein and fixable therewith such that said handle structure and an extended dimension of the blade are co-directional with a longitudinal tool axis;

a stop receivable in said central bore and movable to user selectable locations along said longitudinal tool axis;

said stop being fixable at a desired one of said selectable locations, an end of the blade member being contactable with a forward side of said stop when said at least a portion of the blade member is received in said central bore;

a blade securement mechanism carried on said handle structure forward of said stop, operation of which selectively inhibits removal of the blade member from said handle structure when said at least a portion thereof is slidably received in said central bore, such that when said end of said blade member is brought into contact with said forward side of said stop and said blade member is secured by said blade securement mechanism, said blade securement mechanism inhibits slidable movement of the blade member in a removal direction and said stop prevents movement of the blade member in a direction opposite thereto when working pressure is applied to said blade member during use; and said blade securement mechanism comprising at least one removable chuck including a shaft portion and a slotted head portion, longitudinal slots in said slotted head portion permitting inward movement of said slotted head portion when compressive force is applied thereto;

a forward end of said handle structure including a threaded front portion, said forward end including structure defining a reception bore in which said shaft portion of a one of said at least one removable chuck is receivable, said slotted head portion shouldering against said forward end of said handle structure;

a threaded compression member threadably engageable with said threaded front portion; and cooperating structure carried on said threaded compression member and said at least one removable chuck for inwardly compressing said head portion when threaded compression member is tightened thereagainst.

7. A tool handle for securably receiving a blade member, comprising:

a handle structure defining a central bore in which at least a portion of an overall length of the blade member is slidably receivable therein and fixable therewith, at least with respect to a removal direction of said blade member, such that said handle structure and an extended dimension of the blade are co-directional with a longitudinal tool axis;

a stop receivable in said central bore for longitudinal movement at least over a range of travel therewithin, said stop being fixable at continuous locations along said range of travel, an end of the blade member being contactable with a forwardly facing side of said stop when said at least a portion of the blade member is received in said central bore;

a blade securement mechanism selectively operable to inhibit movement of the blade member at least in said prevent removal direction;

said blade securement mechanism comprising:

a forward end of said handle structure defining a chuck portion;

an internally threaded compression member; and said chuck portion including external threads for threadably engaging said threaded compression member, a portion of said central bore in a region of said chuck portion defining a reception bore having internal walls engageable with said at least a length portion of the blade member, threads of at least one of said compression member and said chuck portion being tapered threads, such that inward pressure is exerted on said chuck portion as said compression member is tightened on said chuck portion, said chuck portion including structure permitting inward compressive deformation thereof in response to said inward pressure whereby inward walls of said reception bore firmly engage said at least a portion of the blade member holding same securely in place.

8. A tool handle for securably receiving a blade member, comprising:

a handle structure defining a central bore in which at least a portion of an overall length of the blade member is slidably receivable therein and fixable therewith, at least with respect to a removal direction of said blade member, such that said handle structure and an extended dimension of the blade are co-directional with a longitudinal tool axis;

a stop receivable in said central bore for longitudinal movement at least over a range of travel therewithin, said stop being fixable at continuous locations along said range of travel, an end of the blade member being contactable with a forwardly facing side of said stop when said at least a portion of the blade member is received in said central bore; and said stop including external threads, said central bore including a threaded portion, extending over at least a segment of said central bore corresponding to said range of travel, for threadable engagement of said external threads therewith, movement of said stop to said continuous locations along said range of travel being accomplished by a turning of said stop.

9. A tool handle for securably receiving a blade member, comprising:

a handle structure defining a central bore in which at least a portion of an overall length of the blade member is slidably receivable therein and fixable therewith, at least with respect to a removal direction of said blade member, such that said handle structure and an extended dimension of the blade are co-directional with a longitudinal tool axis;

a stop receivable in said central bore for longitudinal movement at least over a range of travel therewithin, said stop being fixable at continuous locations along said range of travel, an end of the blade member being contactable with a forwardly facing side of said stop when said at least a portion of the blade member is received in said central bore;

said stop including external threads, said central bore including a threaded portion, extending over at least a segment of said central bore corresponding to said range of travel, for threadable engagement of said external threads therewith, movement of said stop to said continuous locations along said range of travel being accomplished by a turning of said stop;

said threaded portion having an opening in a rearwardly facing end of said handle structure; and said stop further including a structural configuration for cooperatingly engaging an adjustment tool inserted through said opening to permit said turning of said stop by the adjustment tool.

10. A tool handle for securably receiving a blade member, comprising:

a handle structure defining a central bore in which at least a portion of an overall length of the blade member is slidably receivable therein and fixable therewith, at least with respect to a removal direction of said blade member, such that said handle structure and an extended dimension of the blade are co-directional with a longitudinal tool axis;

a stop receivable in said central bore for longitudinal movement at least over a range of travel therewithin, said stop being fixable at continuous locations along said range of travel, an end of the blade member being contactable with a forwardly facing side of said stop when said at least a portion of the blade member is received in said central bore;

a blade securement mechanism selectively operable to inhibit movement of the blade member at least in said prevent removal direction;

said blade securement mechanism comprising:

at least one removable chuck including a shaft portion and a slotted head portion, longitudinal slots in said slotted head portion permitting inward movement of said slotted head portion when compressive force is applied thereto;

a forward end of said handle structure including a threaded front portion, said forward end including structure defining a reception bore in which said shaft portion of a one of said at least one removable chuck is receivable, said slotted head portion shouldering against said forward end of said handle structure;

a threaded compression member threadably engageable with said threaded front portion; and cooperating structure carried on said threaded compression member and said at least one removable chuck for inwardly compressing said head portion when threaded compression member is tightened thereagainst.

11. A tool handle for securably receiving a blade member, comprising:

a handle structure defining a central bore in which at least a portion of an overall length of the blade member is slidably receivable therein and fixable therewith, at least with respect to a removal direction of said blade member, such that said handle structure and an extended dimension of the blade are co-directional with a longitudinal tool axis;

a stop receivable in said central bore for longitudinal movement at least over a range of travel therewithin, said stop being fixable at continuous locations along said range of travel, an end of the blade member being contactable with a forwardly facing side of said stop when said at least a portion of the blade member is received in said central bore;

said stop including external threads, said central bore including a threaded portion, extending over at least a segment of said central bore corresponding to said range of travel, for threadable engagement of said external threads therewith, movement of said stop to said continuous locations along said range of travel being accomplished by a turning of said stop;

an advancement member rotatably mounted to said handle structure a portion of which extends through said threaded portion of said central bore, said advancement member including a reception bore through which said at least a portion of the blade member is receivable, said stop including a plurality of longitudinal slots cut through said external threads thereof, said advancement member including a plurality of arms configured to pass freely through said longitudinal slots in said stop, means within the handle structures for retaining terminal ends of said arms and permitting rotation of said advancement member about a fixed axis; and means operable to selectively prevent rotation of said advancement member with respect to said handle structure.

* * * * *